US007484468B2

(12) United States Patent
Russell

(10) Patent No.: US 7,484,468 B2
(45) Date of Patent: Feb. 3, 2009

(54) BUOYANT MOUNT FOR SUPPORTING CINEMATOGRAPHIC APPARATUS

(75) Inventor: Sean Anthony Joseph Russell, Brighton & Hove (GB)

(73) Assignee: Sean Russell (GB)

( * ) Notice: Subject to any disclaimer, the term of this patent is extended or adjusted under 35 U.S.C. 154(b) by 43 days.

(21) Appl. No.: 11/784,590

(22) Filed: Apr. 9, 2007

(65) Prior Publication Data

US 2008/0248703 A1 Oct. 9, 2008

(51) Int. Cl.

| | |
|---|---|
| ***B63B 1/10*** | (2006.01) |
| ***B63B 43/14*** | (2006.01) |
| ***B63C 11/49*** | (2006.01) |
| ***G03B 17/56*** | (2006.01) |

(52) U.S. Cl. ..... 114/61.1; 114/61.16; 114/123; 441/135; 396/419; 396/428

(58) Field of Classification Search ..... 114/61.1, 114/61.15–61.19, 61.23, 123, 283, 284, 292; 396/419–418; 441/135

See application file for complete search history.

(56) References Cited

U.S. PATENT DOCUMENTS

| | | | | |
|---|---|---|---|---|
| 3,473,502 | A * | 10/1969 | Wittkamp | 114/61.23 |
| 3,929,085 | A * | 12/1975 | Mason | 114/123 |
| 6,065,414 | A * | 5/2000 | Hulbig et al. | 114/56.1 |
| D457,595 | S * | 5/2002 | Ellsworth et al. | D23/200 |
| 6,718,130 | B2 * | 4/2004 | Grober | 396/55 |

FOREIGN PATENT DOCUMENTS

DE 3913155 A1 * 11/1989

* cited by examiner

*Primary Examiner*—Ajay Vasudeva

(57) ABSTRACT

A collapsible, height-adjustable support device with inflatable floats for mounting articles, particularly cinematographic apparatus, upon and below the water. It is characterized by a central tubular frame (1) with a plurality of detachable support arms (2) perpendicular to the central frame. The support arms also attach to the elongate inflatable buoys (10). Cinematographic apparatus is mounted upon a fixing plate (5) positioned centrally on the central frame member (1). The adjustable height of the mount above and below the surface of the water is facilitated by the angular relationship of the central longitudinally splined frame member (1) and each support arms splined hub. Footpads (4) with releasable locking pins and receiving plates (22) provide attachment of support arms to the floats (10). Anchorage and tether points (14) permit towing and static deployment.

11 Claims, 10 Drawing Sheets

BUOYANT MOUNT FOR SUPPORTING CINEMATOGRAPHIC APPARATUS

BACKGROUND OF THE INVENTION

This invention relates to a collapsible and floating camera support device allowing cinematography to be performed upon and within a body of water in a static position or moving within it.

Camera operators currently filming upon the sea, rivers, pools and reservoirs utilize boats, dinghies, oil drum rafts and foam core floats to support the camera and to maintain positive buoyancy for the camera and themselves. A drawback of these methods is that they fix the height of the camera and field of view, not allowing for quick repositioning and resetting of the cameras height and field of view, relative to the subject. It also utilizes land based support equipment such as tripods in a water environment and by doing so it compromises the speed, efficiency, picture composition and directorial instruction. The nature of any hulled style camera support means that the camera and its view can never actually be at the waters surface level, unless it is hung over the hull side and thus inhibiting operation. The other problem if the camera is not hung over the side, the minimum height of view above the water line is determined and begins only at the top of the hulls side. Invariably photographic subjects in water rest on the water below the topside of any hull, therefore filming from a hulled watercraft results in a downward viewpoint.

A cameraman immersed in the water holding the camera afloat by means of a Styrofoam board or himself is easily fatigued, and when filming is required at a depth greater than his physical height, then the camera height or vertical angle of view, either in the water column or in the air above the water line will be dictated by the vertical position of the Styrofoam board support or the endurance of the cameramen's ability to lift the camera to the desired position whilst treading water, which is extremely fatiguing. Filming a scene or sequence is slow and repetitive. The need to replicate the same camera movement is necessary to ensure that all the components of filmmaking come together to create the take that will be screened.

For film crews working in water, let alone cold, deep water or uncontrolled action sequences, exposure to the water for prolonged periods of time will shorten the filming day or compromise the shoot. Even in so called controlled water environments such as tanks and pools, camera crews using hand held camera methods are quickly fatigued by waiting in water whilst actors or subjects are re-staged or the lighting adjusted When filming upon and within water situations, the use of a boat or a dingy as camera support platform may be ruled out due to their size, maneuverability, and accessibility to the filming location and if there is a need to maintain a level of water purification in locations such as swimming pools. The need to prevent introduction of pollutants and contaminating the chosen water environment is critical to any body of water.

When utilizing any of the aforementioned methods of camera support the ability to be able to tilt the cameras field of view, at any height, level with the water, downwards through 90 degrees into the water is impaired by the fixed solid base of the platforms coming into view.

SUMMARY OF THE INVENTION

Prior art includes Watercraft stabilizer system, Grzybowski U.S. Pat. No. 6,305,306 B1, Underwater camera fixture, Fuji Photo Film Co Ltd JP 2004125849, Elsworth et al, Tripod floating mount for a pond aerator U.S. Pat. No. D457, 595 S, Floating type video camera device Nitta JP 62289061, Weed Alvern C U.S. Pat. Nos. 5,074,233, 4,919,632. Weal Clive Barry GB2400349. Stabilized buoy platform for cameras,sensors, illuminators and tools, Grober US 2004/0208499. None of which is successful in providing the flexibility of operation in cinematography with the quick assemblage needed, height adjustability as well as the facility to be discretely set in place by anchorage or tethering and left unattended.

To overcome these restrictions, it is the inventions objective to provide an independent modular floatation device for a camera mount, with the ability to alter the height of the cameras angle of view in measured increments above and below the water line, by easily adjustable support legs and frame members connected to the inflatable buoyancy floats.

It is a further objective of the invention to provide a device that accommodates a single person assembly and operation in the water. To facilitate controlled camera operation and maneuverability by a person in the water both within and out of their depth.

With reference to the buoyancy of the device provided by a plurality of inflatable buoyancy floats supporting the frame, mount, camera, sealed camera housing and operator, it is an aspect of the device such that each elongated inflatable float is of a pre-determined dimension providing sufficient inflation buoyancy support for the total weight of the member frame, support arms and camera, in the case of deflation of a single inflatable float due to damage or fault. A dual or multiple float system ensures a safety factor, allowing retrieval of any valuable cinematographic apparatus and footage from the waters surface.

It is a further objective of the invention to provide a single person portable and modular device that may collapse into a single plane for facilitating ease of storage and shipment.

It is a further objective of the invention for the inflatable buoyancy floats to aid the positioning of the device over a body of water and then for the buoyancy floats to be deflated in the water environment allowing the unit to sink through the water column to the waterbed and provide a stable support base for a stationery fixed filming point on the waterbed, operated by an operator using (SCUBA), self contained breathing apparatus.

It is a further object of the invention to be able to tilt the cameras view, unimpeded through 90 degrees, from above a waterline through to looking directly below the support device under the water, a view perpendicular to the inflatable support pontoons.

It is a further objective that two sets of central frames and support arms can be attached to the inflatable buoyancy floats, one in an under-slung position below the water line and the second assembly in a raised position above the water line.

It is a further object of the invention to provide the ability to attach multiple frame members and support arms together with additional inflatable floats to form a side by side chained plurality of camera viewpoints whilst still all in the same plane.

Another objective of the invention is to provide a device with a buoyant support so that in regard to filming scenes of sport, wildlife or prolonged surveillance in waters that is hazardous due to speeding vessels, presence of dangerous or timid wild life, strong currents or cold water, the floating device can be tethered or anchored in a position without a camera operator. Providing a discreet and safe vantage point within a body of water that would previously be considered too dangerous, or using methods of camera support previously thought to be incongruous and unworkable.

It is a further objective of the invention to be easily deployed from within the body of water, from the side of a watercraft, launched from a pier or shoreline. The supporting devices weight and portability permit a single operators construction, launch and operation of the unit and apparatus set upon it from within the water and retrieval of the device.

It is a further objective of the invention to provide a camera mounting system that when constructing the device, the plurality components of support arms, buoyancy floats, foot pads and receiving plates, are identical in every manner so that each type is not side or direction specific when constructing. The use of interchangeable alike components creates easier and quicker construction and reduces the numbers of spare components needed and carried during deployment in case of damage or loss.

BRIEF DESCRIPTION OF THE DRAWINGS

The invention will now be described solely by way of example and with reference to the accompanying drawings in which.

DETAILED DESCRIPTION OF THE DRAWINGS

Figure 6:
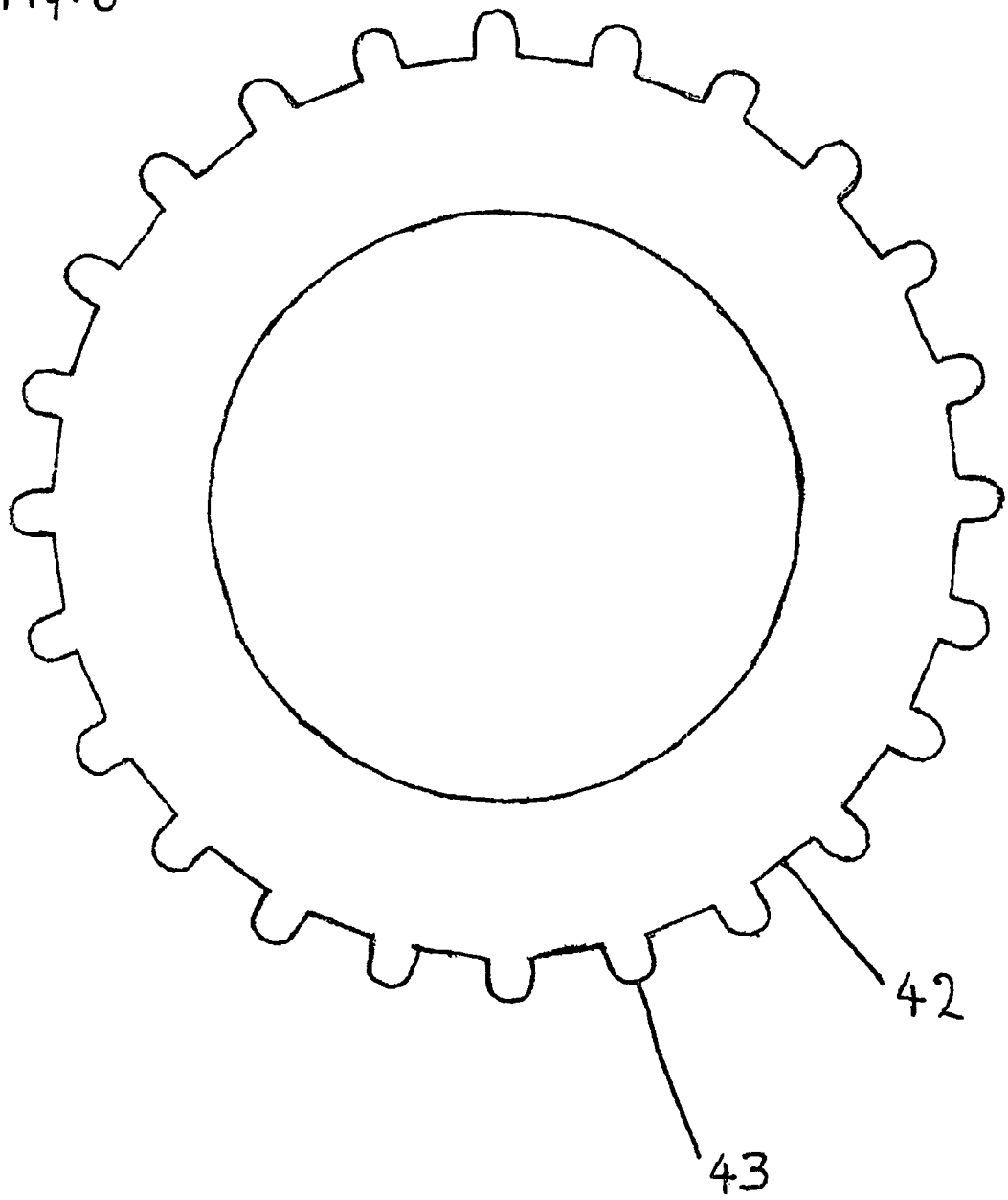
FIG. 6 shows an end cross-section profile of the tubular central frame member displaying the splined tooth engagement hubs.
Figure 7:
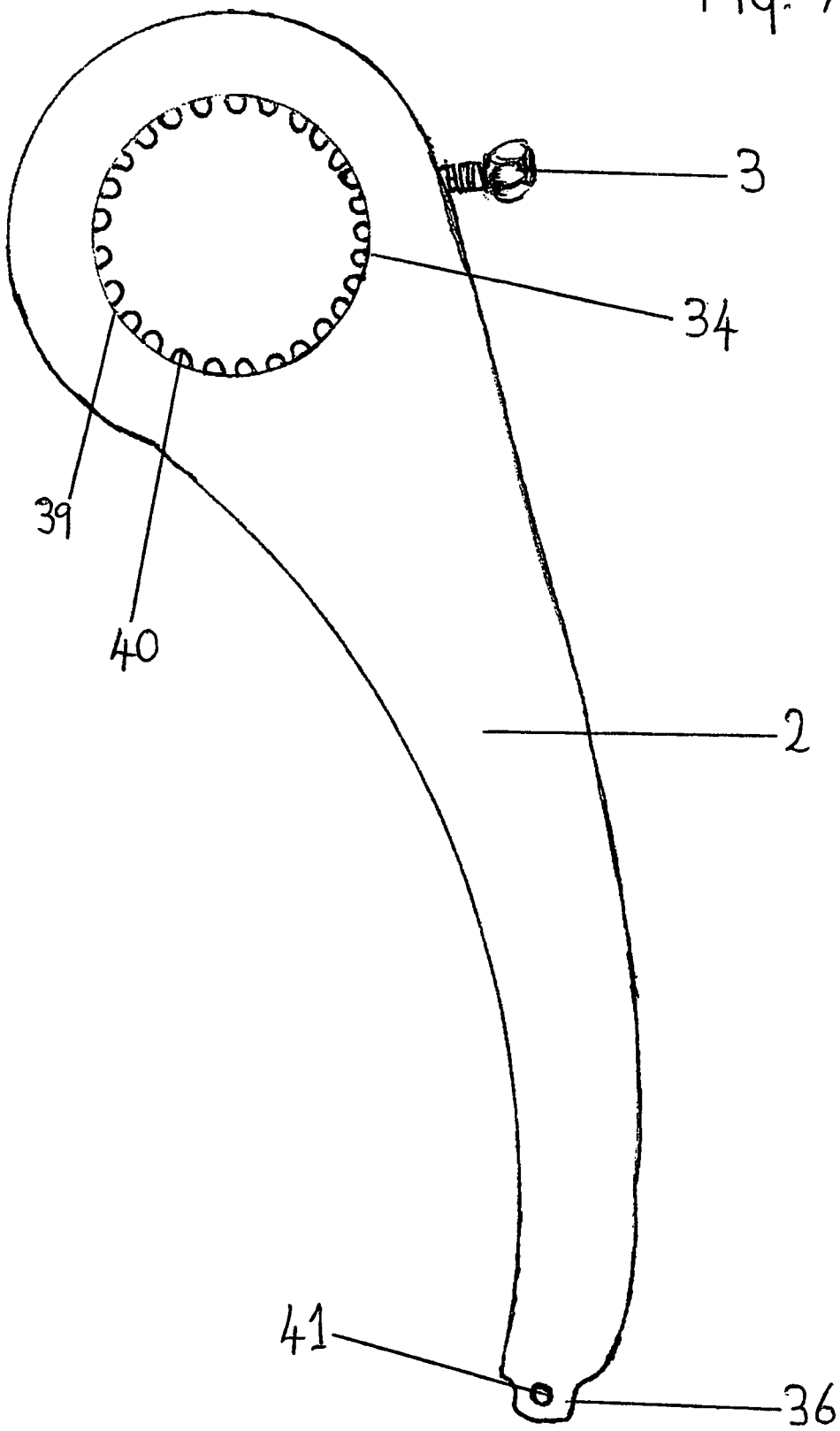
FIG. 7 shows a side view of the arced support arm featuring the toothed inner hub.

The invention relates to an inflatable buoyancy camera support device with a height adjustable camera mounting plate. Comprising of a plurality of elongate inflatable buoyancy pontoons. A longitudinally splined tubular central frame member with an outer surface provided with a plurality of longitudinally extending grooves. A plurality of longitudinally curved support arms radiating at 90 degrees to the splined frame member 1 in FIG. 1. They connect to the inflation floats 10 at one end of the support arm 2 and are assembled to the central frame member by way of a splined hub at the other end of the support arm. The assembly of the splined shaft member FIG. 6, and the internally splined support arm hub 34 FIG. 7, is by way of both members having a splined tooth like profile that correspond to each other. The circular splined central frame member 1 is threaded through each of support arms corresponding internally splined hubs allowing the support arms to travel longitudinally along the central frame member.

Figure 5:
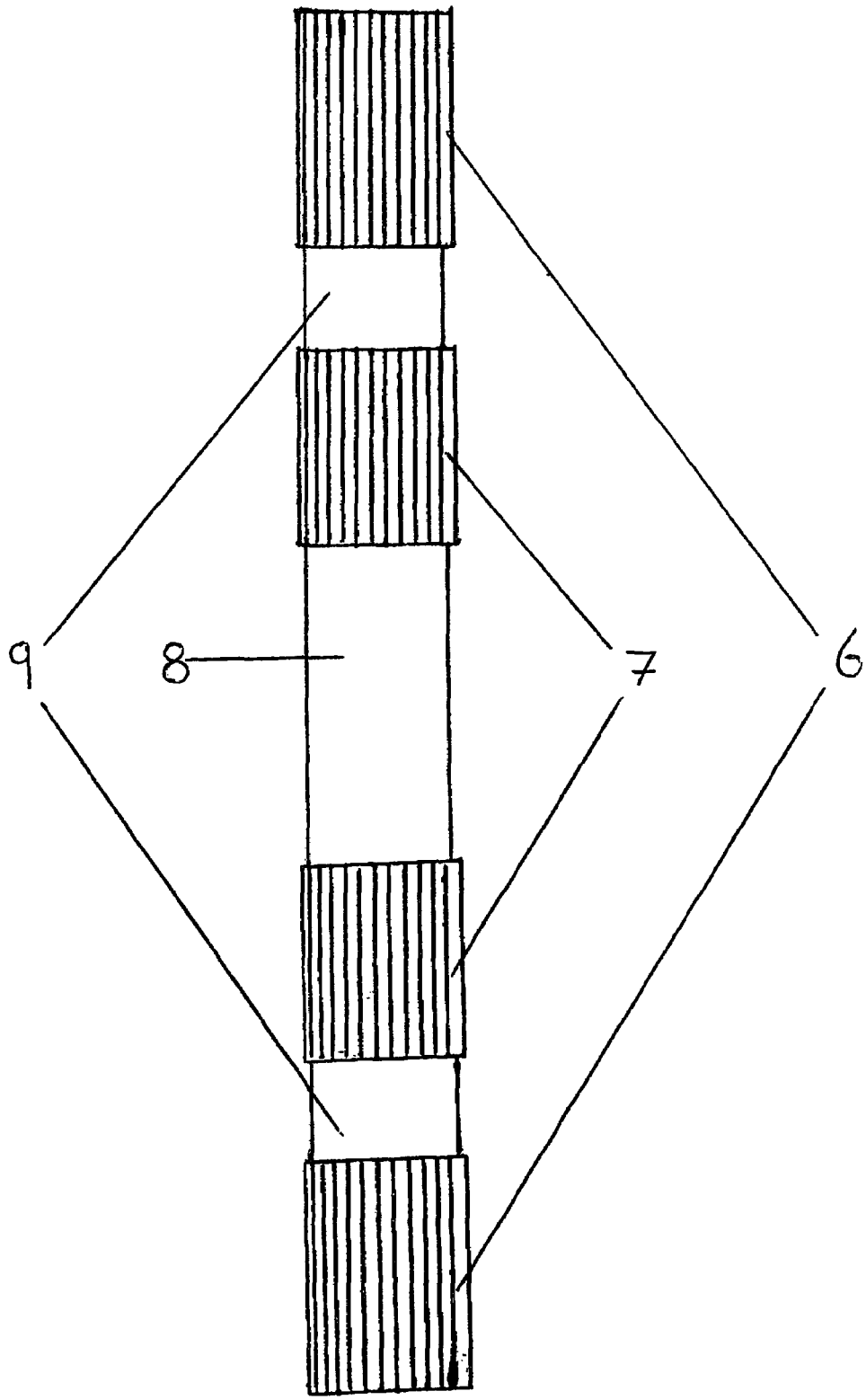
FIG. 5 shows a profile view of the inventions tubular central frame member with splined engagement hubs and inner centering hubs.

Rotational movement of the support arm is fixed by way of the splined member profiles 6,7 in FIG. 5, engaging and fixing the rotational movement of each support arm hub FIG. 7, 34, at a desired position along the longitudinal member. A locking screw 3 in FIG. 1 and FIG. 7 on the support arms hub can be rotated from the support arms exterior hub, turned to an extent so that the screw may be guided through the hub into a gap formed between two splines on the frame members 1 outer surface preventing further longitudinal travel.

The angular relationship of a plurality of support arms and the central tubular splined frame support member 1 means incremental adjustments can be made by altering the rotational axis of the support arms splined inner hubs 34 FIG. 7, in relation to the splined central tubular frame member 1. The angular adjustments of the central mounting frame and the support arms allows the cameras viewing height to be raised or lowered into either an under-slung position FIG. 1 in respect to the inflation buoyancy floats and the waterline, or in increments upwards so that the cameras viewing height may be supported upwards in FIG. 2 above the waterline and the inflation buoyancy floats.

The incremental adjustment of the angular relationship between the central fame member 1 and the support arms 2 is by means of the corresponding shaft 6,7 and hub splines 34. The tooth like splines, FIG. 6. 42, 43 are evenly arranged about the circumference in a size and manner that results in about 24 separate engagement splines. This allows incremental angular adjustment of 15 degrees rotation about the central splined member shaft 1.

Figure 3:
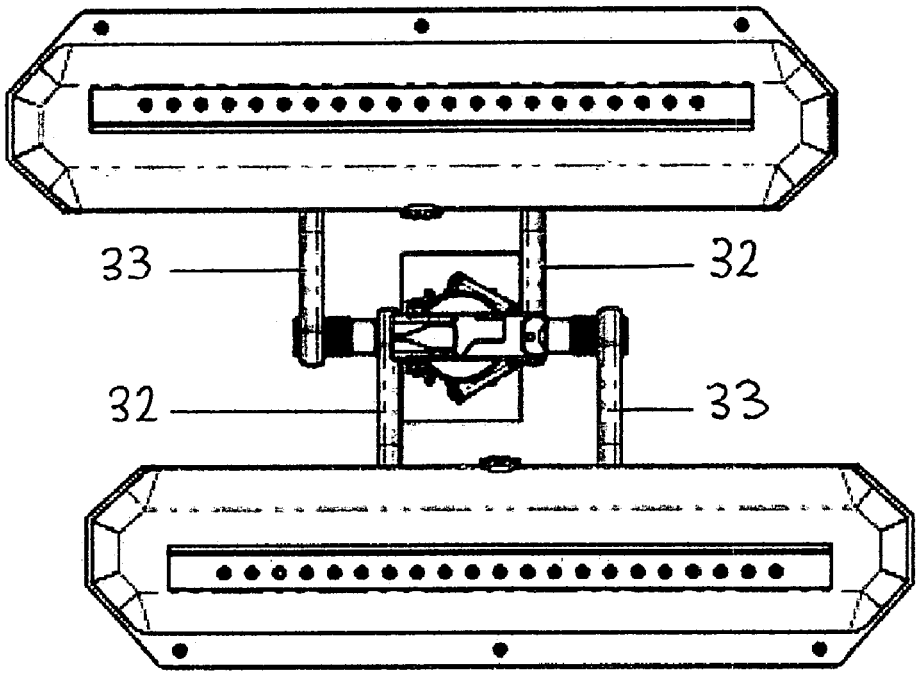
FIG. 3 shows a top view of the assembled invention.
Figure 4:
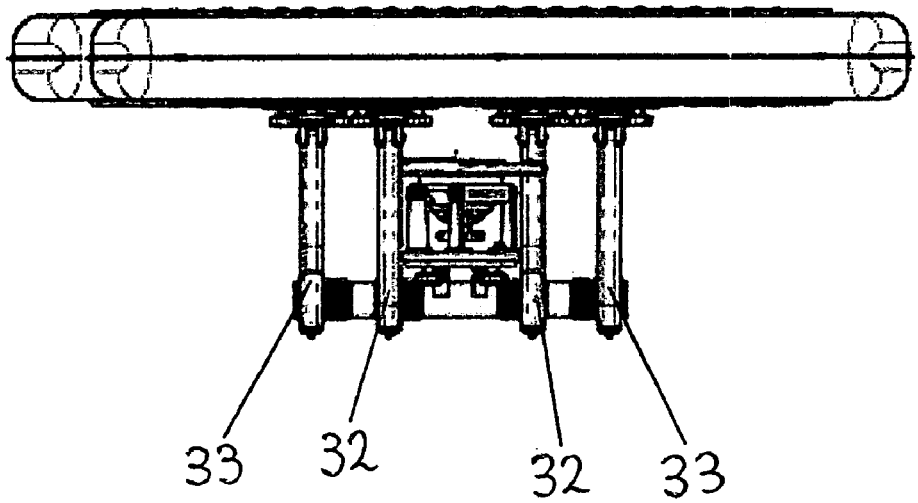
FIG. 4 shows a side profile of the invention in an under-slung mode.

As displayed in FIGS. 3 and 4 the device comprises of at least two, spatially aligned, elongate inflatable buoyancy floats 10. The central frame member 1 is assembled together with the plurality of support arms 2 to provide the means for maintaining the spatial relationship between the buoyancy floats.

This spatial relationship can be changed, depending on the angular adjustments of the support arms hub in relation to the central frame members engaging hub. This height adjustment when raising up or sinking down of the central mounting frame will draw the buoyancy floats into a closer spatial relationship than if the central mount was to be adjusted into a centered lateral position. The buoyancy floats are at their furthest distance apart when the buoyancy floats support arms and central frame member all lay in the substantially same plane.

Figure 2:
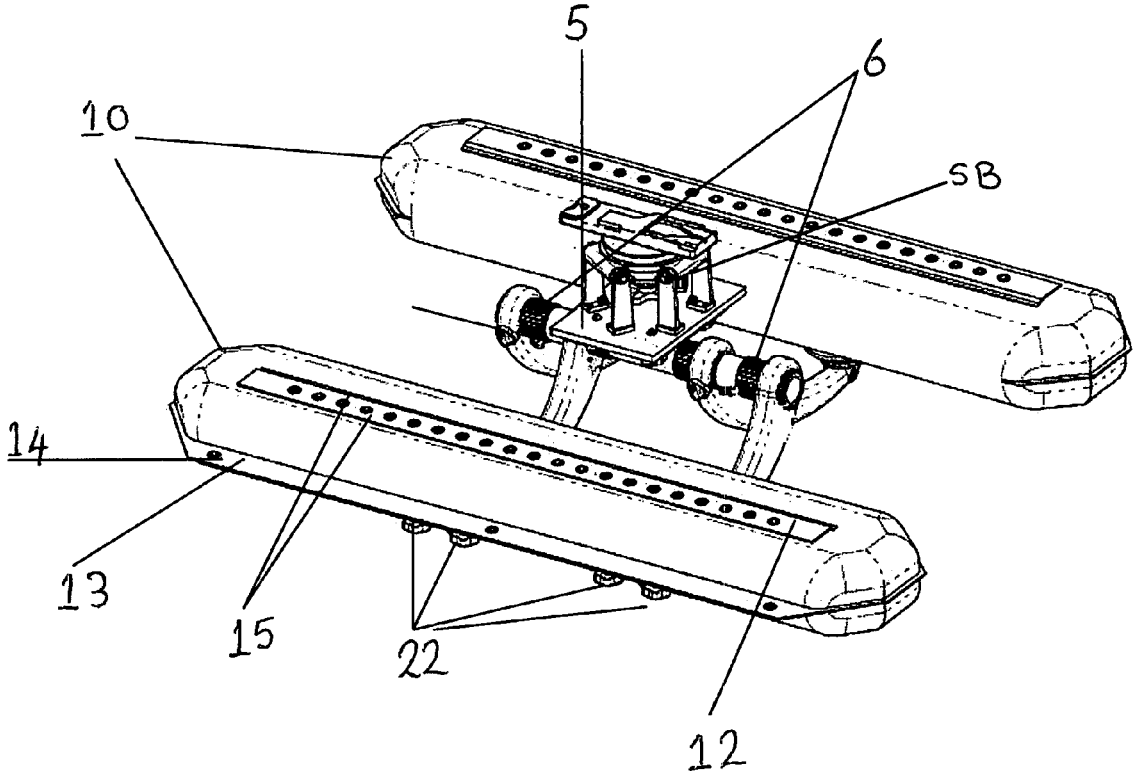
FIG. 2 shows a view of the invention in a raised, above the waterline mode.

As shown in FIG. 2 the central tubular member has a centrally located mounting plate 5 for a standard television and film camera head levelling bowl (SB) to be positioned.

Figure 8:
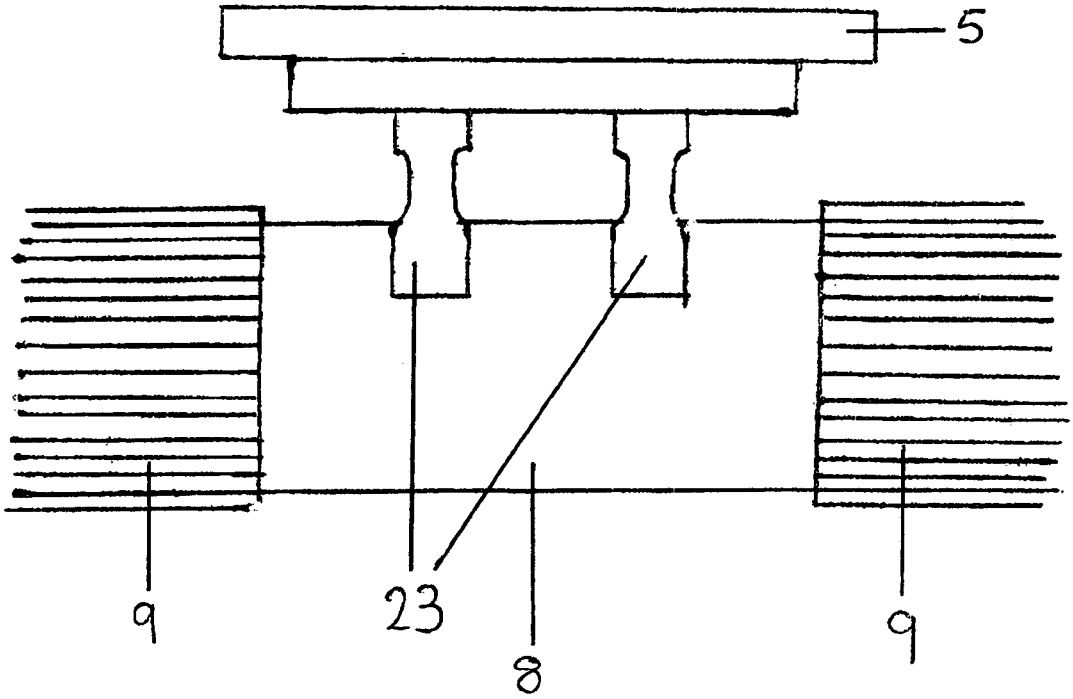
FIG. 8 shows a side profile of the saddle mounting brackets and mount plate positioned onto the tubular central members cylindrical central surface.

The diagram FIG. 8 displays the position of the saddle brackets, in a central hub region of the central frame member devoid of longitudinal splines. This cylindrical surface is at an inner diameter formed, seen in FIG. 5 to correspond approximately with the inner diameter 42 in FIG. 6 of the shaft splines of the central frame member and the inner diameter of the splines 40 FIG. 7 of the support arms inner splined hubs. The outer diameter of splines on the support arms inner hub is denoted by 39 on FIG. 7 and corresponds to the central frames outer diameter of splines 43 FIG. 6.

The mounting displayed in FIG. 8 comprises of two perpendicular saddle spacing brackets 23 at a spatial distance to give the most effective support for the size of mounting plate positioned upon the central frame member 1.

Figure 10:
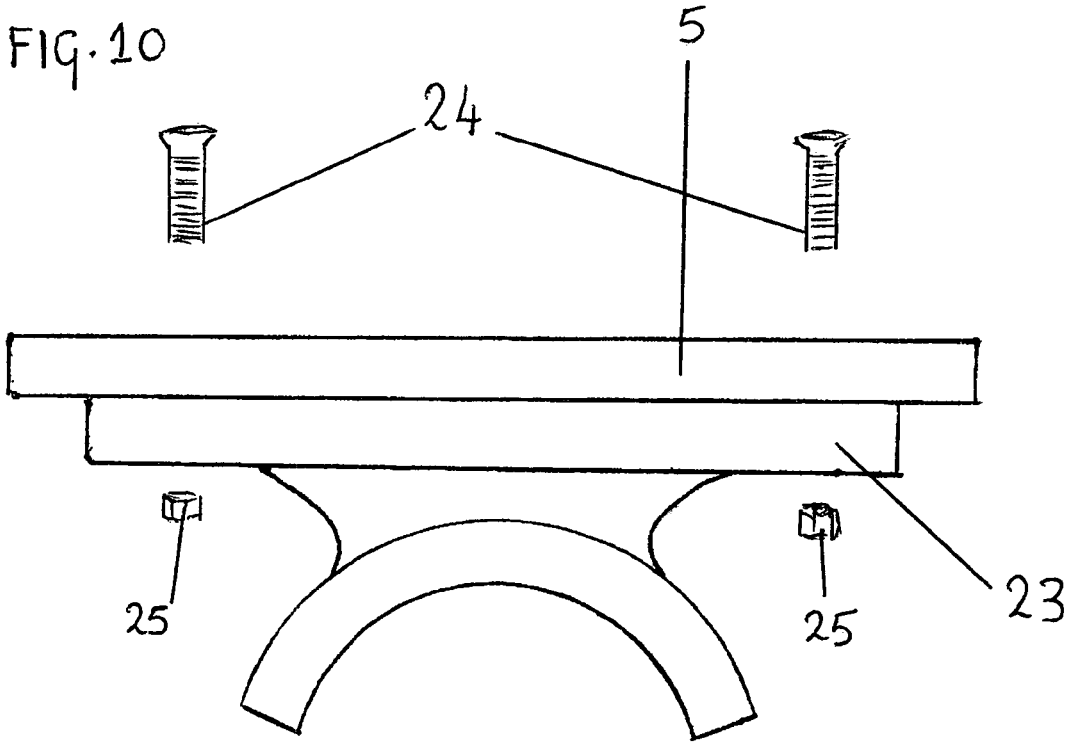
FIG. 10 shows a side profile of the saddle-mounting bracket together with the top mounting plate.
Figure 11:
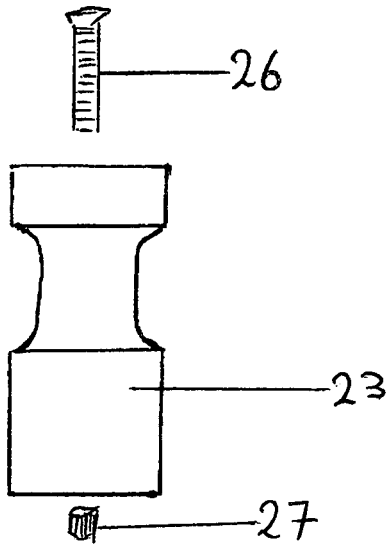
FIG. 11 shows an end profile of the saddle-mounting bracket together with the fixing attachments.

The saddles cylinder abutment profiles, FIG. 10, are at an arc profile mirroring the circumferential profile of the central frame member, so that the load force exerted downwards when a camera is positioned upon the mount is evenly distributed across the top profile of the central frame member 1. The saddle spacing brackets are fixed to the central tubular frame by means of threading a rotational bolt 26 in FIG. 11 down through the centre of the saddle threading through the central frames tubular surface and engaging a washer and nut 27 on the central frame members inner tubular surface. The rotational engagement of the bolt head threads the nut and draws them together, sandwiching the saddle spacing bracket and the central frame member between the bolts rotational head and the nut and washer. The bolts rotational head is countersunk on the top threading side of the saddle bracket to permit placing and fastening a flat plate on top.

Also shown in FIG. 10 is the square mounting plate 5 for the camera heads standard levelling bowl coupling SB. This plate 5 is fixed in a position by a plurality of bolts 24 threading down through the mounting plate and through the flat top profile of the mounting saddle spacing bracket 23. Rotation of the bolt head threads the screw into the washer and nut 25 on the saddles underside drawing the plate 5 and the saddle bracket 23 firmly together in to a fixed position.

Referring to FIG. 5 the tubular central frame member has three equally spaced cylindrical surface inner centering hubs 8 and 9 along its longitudinally splined surface. FIG. 5 illustrates the spatial relationship of the splined sections 6 and 7 and the cylindrical surface inner centering hub sections 8 and 9 of the centeral frame member 1. Mirroring the centeral hubs cylindrical surface, the outer placed inner centering hubs 9 cylindrical surfaces is at an inner diameter formed to correspond approximately with the inner diameter of the shaft splines of the centeral frame member.

The outer placed inner centering hubs 9 provide the means for the support arms 32 and 33 displayed in FIG. 3 to be longitudinally disengaged from the complementary interlocking splines and slipped into the inner centering hub and the circumferential direction of the support arms changed without the need to remove the outer placed support arm 33 in FIG. 3 or remove from the centeral frame shaft.

FIG. 3 Illustrates the intended configuration of the centeral frame member 1 and the plurality of support arms 2 attaching to the inflatable buoyancy floats 10.

Figure 9:
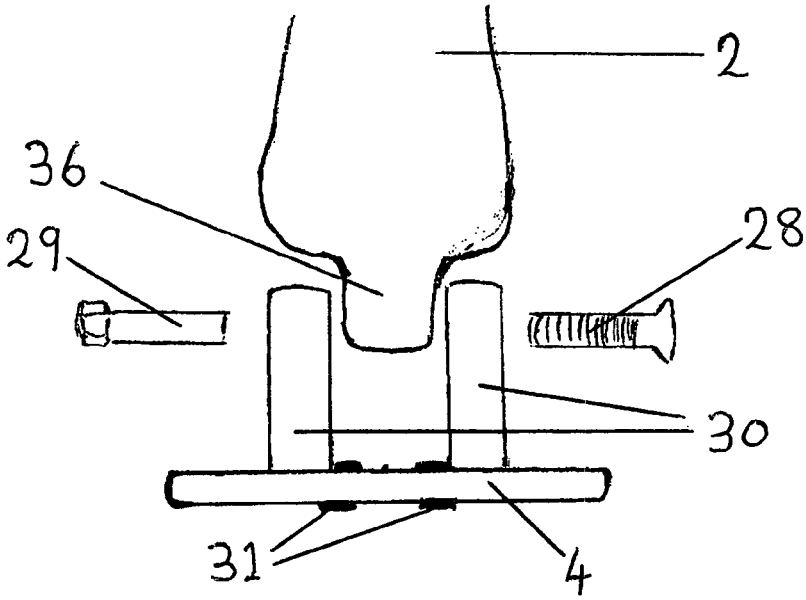
FIG. 9 shows the assemblage of the pivotal footpads engagement with an end of the support arm.
Figure 14:
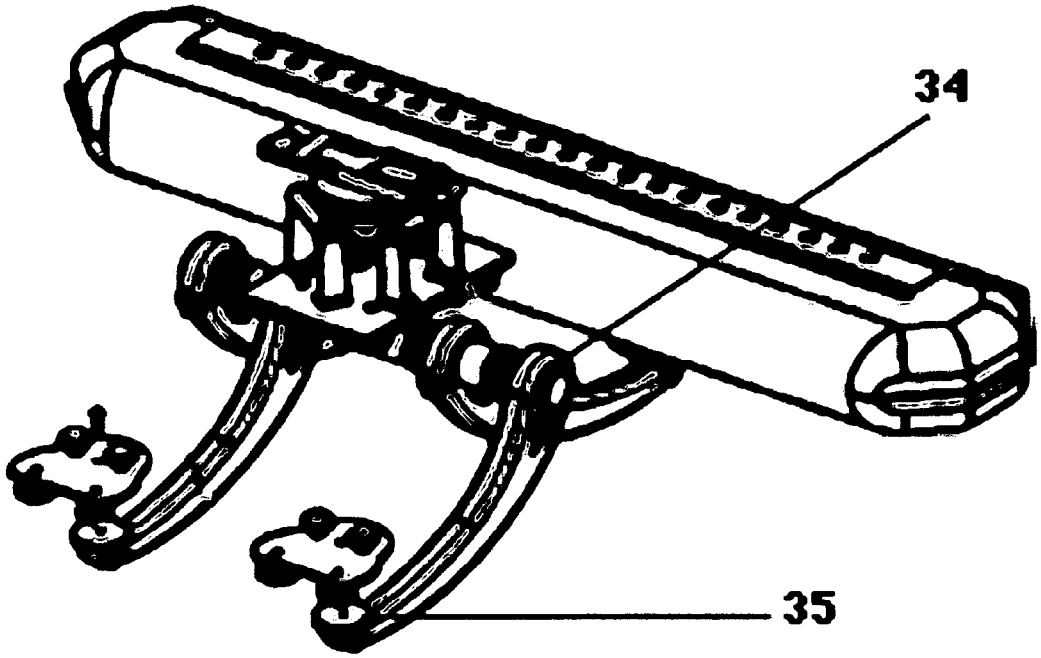
FIG. 14 shows a view of the invention with a single side assembled to an inflatable buoyancy float and the other side displaying the quick release assemblage between the support arms and floats

In FIG. 14 the attachment end 35 opposite to the splined hub 34 on the support arm 2 is the free-moving pivotal footpad 4 attachments. The footpad is represented by FIG. 9 and comprises of a circular footpad with two triangular upstanding lugs 30 perpendicular to the circular footpad 4, forming a clevis yoke. The space between the clevis yoke complements the dimensions of the support arms attachment lug 36. The footpad 4 is positioned onto the support arms protruding lug by means of a socket shoulder screw 28 with a rotational head threading into a receiving nut 29, this assembly then acts as a clevis pin. The retaining pin 28 and 29 passes through aligned apertures in the clevis yokes walls 30 and through the aligned aperture 41 in FIG. 7, on the support arms lug 36 holding the footpad and support arms together.

This configuration allows the footpad to pivot in one plane about the circumference of the socket shoulder screw 28 and 29. The cylindrical outer surface of the shoulder screw provides the least amount of friction for the footpad to swing upon.

The rotation of the footpad extends from the front of the support arms lug 36 travelling through to the rear of the same lug. This free movement allows the footpad to find a flat balanced base irrespective of the support arms angle of inclination with regard to the fixed setting of the splined hub assembled together with the splines of the central frame member 1.

Figure 13:
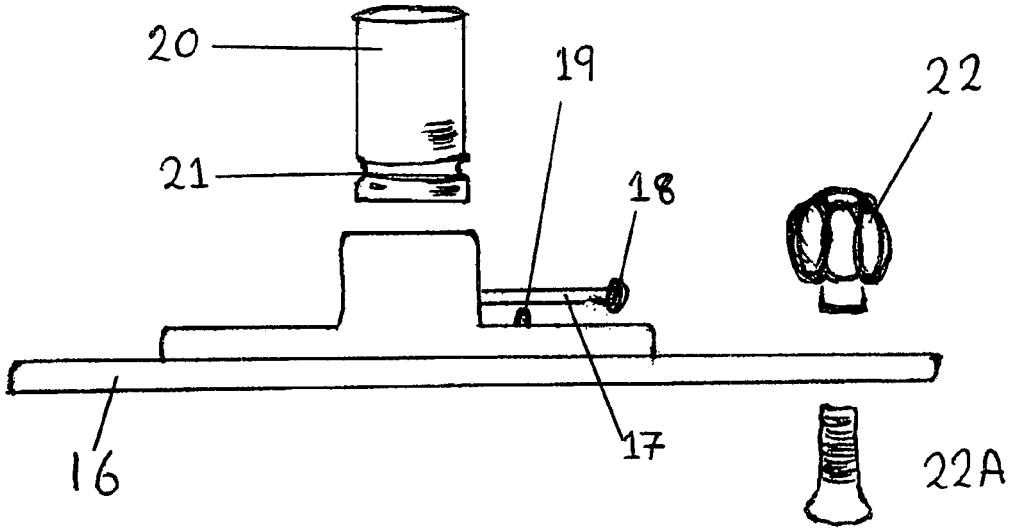
FIG. 13 shows and exploded front view of the quick release locking assembly and locking pin.

At the footpads circular centre is an aperture within which a threaded insert 31 is located to receive the thread of a bolt, holding a securing pin 20 in FIG. 13, of the quick release assemblage. This securing pin 20 has a cylindrical surface and is rebated with a retention groove 21 along its outer circumferential profile.

The threaded bolt travels longitudinally through a central aperture in the securing pin assembling it to the footpad 4. The base of the securing pin is counter-sunk to accommodate the threaded bolts rotational head. As shown in FIG. 13 when this male securing pin 20 is inserted into a retaining plate 16 with a corresponding female aperture, the securing pin 20 can be locked in place within the aperture by two sliding locking pins 17 FIG. 12. Positioned in a parallel plane on a releasable arced slider 18, engaging the grooved outer rebates 21 on the securing pin cylinder. Preventing release from the plates receiving aperture. The back plate 16 has a protruding sprung retention clip 19 in line with the locking pins sliders direction of travel.

Situated on the plate's 16 innermost travel of the slider 17 and 18, it serves to keep the locking pins engaged and must be depressed to allow the slider 17 and 18 to extend away disengaging the locking pins 17 from the securing cylinder 20 and disengaging the lock. This locking together performs the function of assembling the central frame 1 and the support arms 2 to the elongated inflatable buoyancy floats 10.

Figure 12:
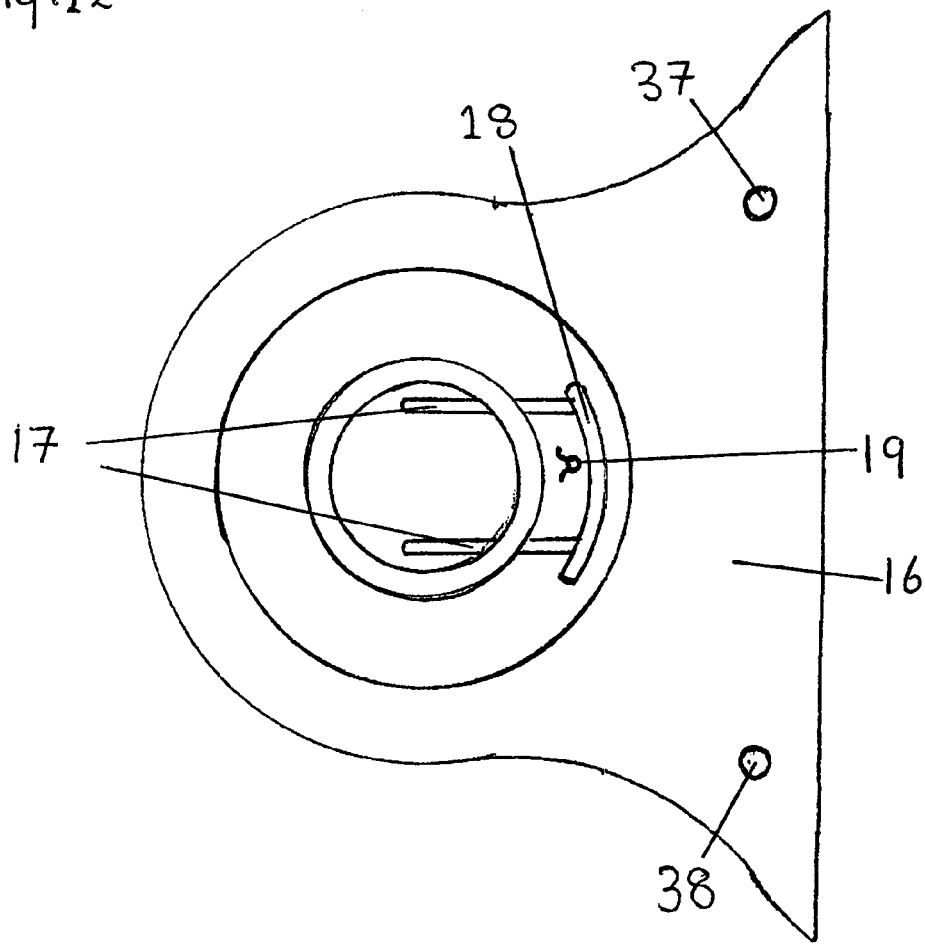
FIG. 12 shows a top view of the quick release locking assembly.
Figure 15:
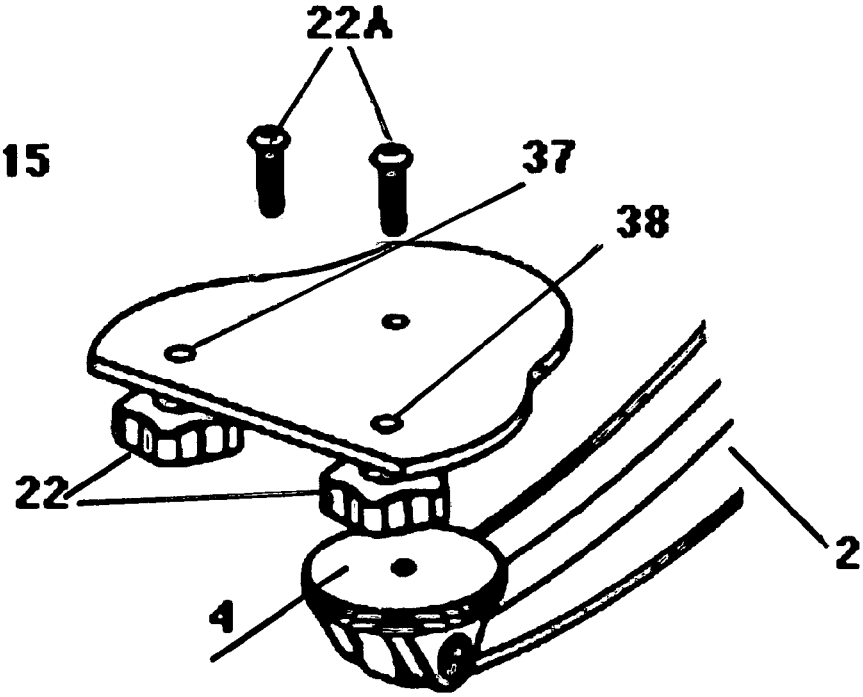
FIG. 15 shows a bottom view of the back plate and attachment bolts for the quick release assemblage.

The back receiving plate 16 of the quick release assemblage is positioned in a manner to align the plates spatially positioned attachment apertures 37 and 38 in FIG. 12 with the Brass eyelet apertures 15 FIG. 2 on the inflatable buoy side-retaining skirts 12. The two are joined by the use of nylon scallop knob inserts and studs 22 and 22A FIG. 15 sandwiching the eyelet 15 and the back plate 16 together. The scalloped knob inserts and studs 22 and 22A allow for ease of tightening and assemblage by hand, in cold, wet conditions without the use of tools.

Figure 1:
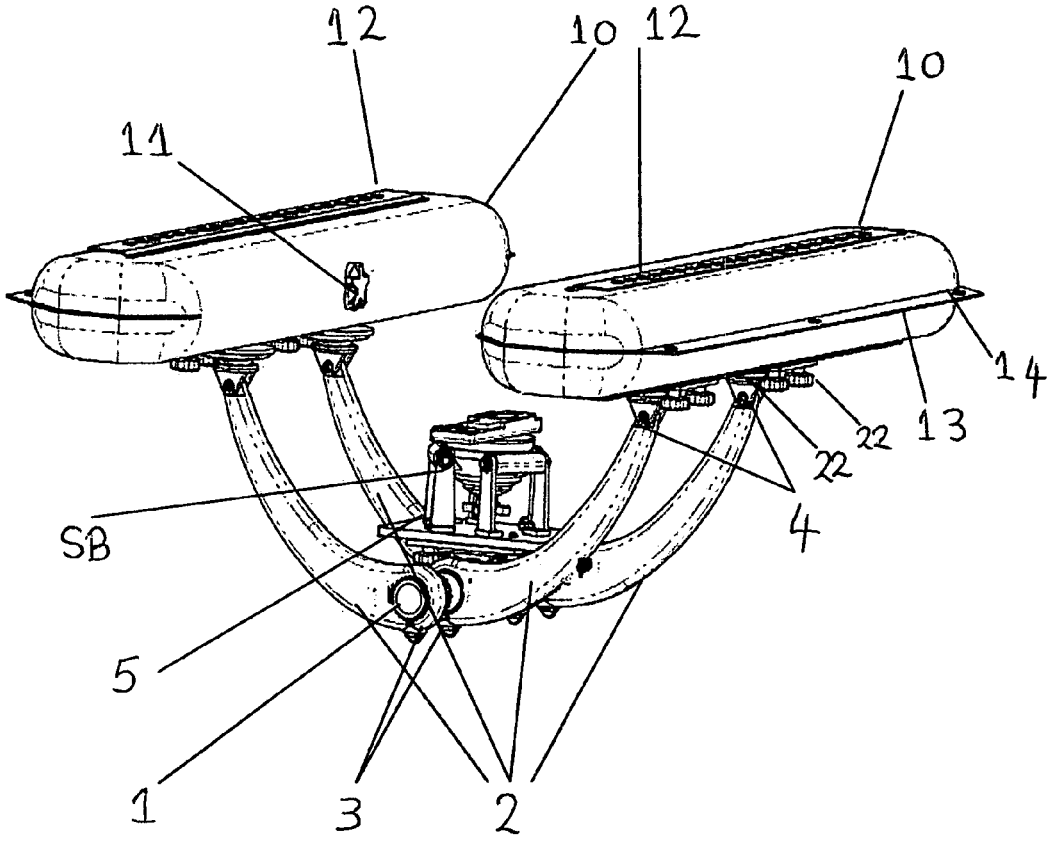
FIG. 1 shows a view of the invention in an under-slung, below the water line mode.

FIG. 1 illustrates the hollow inflatable buoyancy floats 10; these are preferably devised from an impermeable chlorosulfonated polyethylene material, with the attributes of strong abrasion and ultra violet ray resistance. The elongated tube has a centrally top mounted inflation/deflation valve 11. In the first mode the valve acts as a non return valve on inflation preventing gas escape. The preferred method of inflation is by a person blowing into the inflation valve or by connecting a standard bellows foot pump. The valve further allows for inflation or deflation within the water environment by the operator to facilitate the desired buoyancy compensation. The operator may by using a finger to depress and locking down an internal valve pin, allow the inflated buoys gas to escape by the open valve and consequently deflate the elongated buoyancy tube.

Along each tube a skirting tab 12 running the length of the inflatable buoyancy float 10 has a plurality of brass eyelets 15. These eyelets 15 allow the back-plates 16 of the quick release assemblage to be positioned and fixed, by way of nylon scallop knob studs and inserts 22 and 22A, anywhere along the length of the inflatable buoyancy float. This connection allows the assemblage of the central frame 1 and support arms 2 to the inflatable buoyancy floats 10. This tab 12 and eyelet 15 configuration is mirrored on the inflatable buoyancy floats opposite side. This allows the use of each of the inflatable buoyancy floats in any lateral direction, so no inflatable buoyancy float is specific to any side. It also permits additional modular frames 1 and support arms 2 to be assembled on the inflatable buoyancy floats opposite side, increasing the number of devices coupled together.

Along the bottom edge of the elongated inflatable tube a protruding skirt 13 with a plurality of equally spaced brass eyelets 14 facilitate fastening points for the support device to be tethered, towed by a watercraft or anchored, by which rope may be passed through the eyelets 14 and tied off.

These eyelets 14 also serve as fastening points between the buoyancy devices and a sea anchor to enable a slow passage in areas suffering from tidal drift and currents. In addition the eyelets 14 would provide fastening points at the inventions lowest point to position removable ballast. This would act to counter any toppling over and inverting of the device, due to wave motion or instability caused by raising the camera the mounts height by changing the angular relationship of the support arms and the central tubular hub. The raising of the camera mount results in the support arms and inflatable buoyancy floats reducing their distance apart.

In preferred construction the central frame member and the support arms are made from a thermoplastic material such as Acetyl, with the characteristics of low water absorption, mechanical resistance, and a low specific gravity, but not sufficiently low to impede immersion in the water column.

All bolts, washers and nuts are to be constructed out of marine grade A4 stainless steel or titanium. This will provide the corrosion resistance required when working in a marine environment.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

I claim:

1. A cinematography apparatus mounting device with inflatable buoyancy floats for support upon and within a body of water, comprising:

a central tubular frame support member;

a plurality of support arm members;

a plurality of inflatable buoyancy floats, of resilient, deformable, impermeable material;

a means to connect the central tubular frame support member, support arm members and inflatable buoyancy floats allowing the rotation of each support arm member about the circumference of the central tubular frame support member independently from other support arm members, a means for locking in position the support arm members perpendicularly to the central tubular frame support member in various circumferential angular relationships to the other support arm members located along the longitudinal axis of the central tubular frame support member;

wherein the central tubular frame support member is provided with inner and outer splined engagement hubs and inner centering disengagement hubs, which are axially aligned, a pair of supporting saddle brackets provided in a spaced relationship at the center of the support members longitudinal axis and a central mounting plate positioned centrally upon said supporting saddle brackets.

2. A cinematography apparatus mounting device with inflatable buoyancy floats for support upon and within a body of water, as claimed in claim 1, wherein the plurality of support arm members are each provided with an inner hub of splined grooves at one end that are complimentary with, and engage with the inner and outer splined engagement hubs of the central tubular frame support member.

3. A cinematography apparatus mounting device with inflatable buoyancy floats for support upon and within a body of water as claimed in claim 2, wherein the splines of the inner hubs of the support arm members and the splines of the inner and outer splined engagement hubs of the central tubular frame support member are adapted to engage to allow positioning of the support arm members such that they extend perpendicularly to the central tubular frame support member and at incremental angular positions with respect to the central tubular frame support member and wherein the inner centering disengagement hubs of the central tubular frame support member allow disengagement of the splines of the central tubular frame support member and the support arm members.

4. A cinematography apparatus mounting device with inflatable buoyancy floats for support upon and within a body of water, as claimed in claim 2 or 3, wherein the inner hub of each support arm member can be locked in regard to movement along the longitudinal axis of the central tubular frame support member by means of a threaded screw passing through the inner hub and engaging a gap between the splines of its respective splined engagement hub.

5. A cinematography apparatus mounting device with inflatable buoyancy floats for support upon and within a body of water, as claimed in claim 4, wherein an extended lug with an aperture adapted to secure a pivoting footpad is provided at the other end of each support arm member, each footpad being provided with a centrally located threading insert to permit assembly of a threaded bolt securing a locking pin, each footpad further comprising two triangular up stands extending perpendicularly to the footpad and forming a clevis yoke with an aperture stands aligned with the extended lug and aperture of the respective support arm member.

6. A cinematography apparatus-mounting device with inflatable buoyancy floats for support upon and within a body of water, as claimed in claim 5, further comprising: a shoulder mounted screw capable of passing through the aligned apertures of each support arm members extended lug and the clevis yoke on its footpad, connecting the footpad to the support arm member.

7. A cinematography apparatus mounting device with inflatable buoyancy floats for support upon and within a body of water, as claimed in claim 1, wherein the means for attaching the inflatable buoyancy floats to each support arm member includes a locking pin receiving plate with a locking pin, said receiving plate having a central aperture to engage the locking pin, a releasable, sprung retention clip positioned on an, in use, top surface of the receiving plate, in line with the locking pin, and a set of apertures to permit a nylon scallop knob threaded stud to pass through the receiving plate and engage a threaded insert on an eyelet skirt of the inflatable buoyancy floats.

8. A cinematography apparatus mounting device with inflatable buoyancy floats for support upon and within a body of water, as claimed in claim 7 wherein, the eyelet skirts are provided on both sides of an elongated tube that forms each inflatable buoyancy float, and a plurality of said threaded inserts are provided along the length of each eyelet skirt to allow support arm members to be moved along the longitudinal axis of the inflatable buoyancy floats.

9. A cinematography apparatus mounting device with inflatable buoyancy floats for support upon and within a body of water as claimed in claim 8, wherein a longitudinal bottom skirt is attached to each elongate inflatable buoyancy float with eyelets to provide anchorage and tethering points.

10. A cinematography apparatus mounting device with inflatable buoyancy floats for support upon and within a body of water, as claimed in claim 9, wherein the eyelets on the longitudinal bottom skirts provide anchor points for a netted sea anchor or ballast to be dragged enabling slow passage and drift.

11. A cinematography apparatus mounting device with inflatable buoyancy floats for support upon and within a body of water, as claimed in claim 10 wherein a plurality of said cinematography apparatus mounting devices can be assembled together using the inflatable buoyancy floats as the linking assembly.

* * * * *